US006895599B1

(12) United States Patent
Templer

(10) Patent No.: US 6,895,599 B1
(45) Date of Patent: May 24, 2005

(54) REVERSIBLE INTERCHANGEABLE STRETCH FASHION GLOVES

(76) Inventor: Joseph A. Templer, 1000 Jefferson Ave., Elizabeth, NJ (US) 07201

( * ) Notice: Subject to any disclaimer, the term of this patent is extended or adjusted under 35 U.S.C. 154(b) by 158 days.

(21) Appl. No.: 10/387,596

(22) Filed: Mar. 14, 2003

(51) Int. Cl.[7] ..... A41D 19/00
(52) U.S. Cl. ..... 2/160
(58) Field of Search ..... 2/158, 161.6, 160

(56) References Cited

U.S. PATENT DOCUMENTS 1,423,546 A 7/1922 Speer
3,063,057 A * 11/1962 Forman ..... 2/161.6
3,258,858 A * 7/1966 Cariffe ..... 36/1
3,821,817 A * 7/1974 Jorgensen ..... 2/169
5,199,876 A * 4/1993 Waldman ..... 434/262
5,898,942 A * 5/1999 Anderson ..... 2/159

* cited by examiner

*Primary Examiner*—Katherine M. Moran
(74) *Attorney, Agent, or Firm*—Myron Amer

(57) ABSTRACT

A glove of stretch construction material so that one size fits all, in which the stretch is used to advantage for its utility to adjust for the discrepancy between the natural and glove construction positions of the thumb and the glove is therefore ambidextrous, so the glove used as a pair has four displays, in which an inside color surface is one, an outside contrasting color surface is two, and contrasting colors on one hand and then on the other hand are three and four, the change of the color surfaces being achieved by turning the glove inside out.

1 Claim, 1 Drawing Sheet

REVERSIBLE INTERCHANGEABLE STRETCH FASHION GLOVES

The present invention relates generally to improvements in children's gloves, the improvements more particularly increasing the options in the appearance of the gloves.

EXAMPLE OF THE PRIOR ART

A glove with contrasting appearances in its internal and external surfaces that can be turned inside out is already known, as exemplified by U.S. Pat. No. 1,425,546 for "Reversible Glove" issued to J. L. Speer on Jul. 25, 1922. According to the '546 patent, an adult can have a material with a dark appearance worn outwardly for street or other wear where they are liable to be soiled and, by turning the gloves inside out, have a lighter colored or white material worn outward for formal wear. Thus, it is noted there is eliminated the inconvenience of carrying a pair of white gloves to: a formal function.

To a child eliminating a functional pair of gloves is of minimal importance, but it would be of significant importance to increase the options of the color display of the construction material of the gloves. The white and dark options of the '546 is an improvement in this respect, but is unnecessarily limited.

Broadly, it is an object of the present invention to overcome the foregoing and other shortcomings of the prior art.

More particularly, it is an object to provide a children's glove with four, not just two, fashion or display options, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
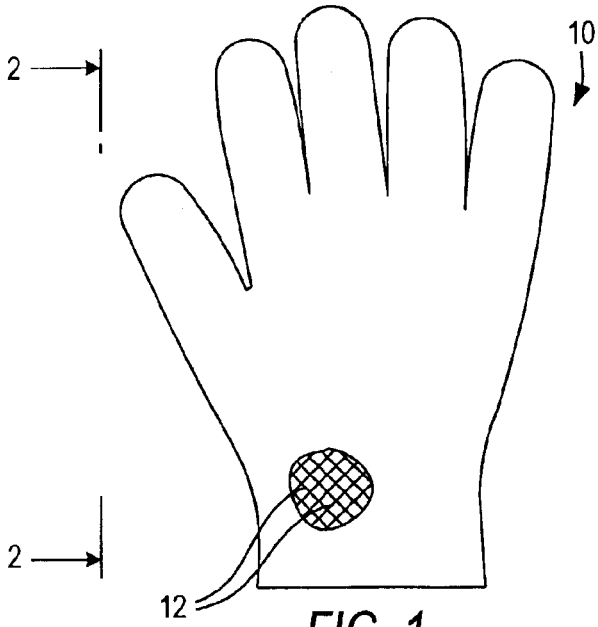
FIG. 1 is a front elevational view, in a palm's up orientation, of a glove of the present invention.

Understood to be used in pairs, is an isolated view in FIG. 1 of one glove, generally designated 10, in a palm's up orientation, made of stretch construction material, either by the use of elastomeric yarns 12 or in another well-known manner, so that glove 10, intended for use by children, is of the popular "one size fits all" variety. Additionally, in accordance with the present invention, glove 10, as may be best understood from the side elevational view of FIG. 2, is hand-interchangeable or ambidextrous, in that it can be worn either on the left hand or on the right hand, because in the glove construction the thumb stall 14 is in the plane of the finger stalls 16, even though the natural position of a thumb is slightly offset to the palm side of a hand, this discrepancy between the thumb stall 14 in the glove 10 and the natural thumb position on a hand being taken account of by the stretch of the construction material which provides good fit on either hand.

Figure 2:
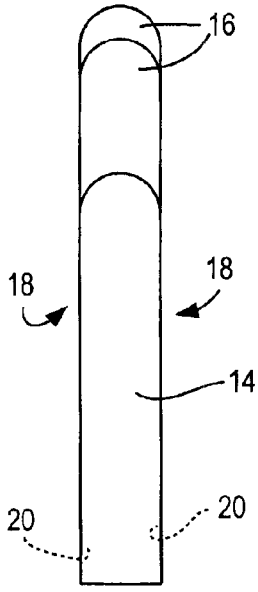
FIG. 2 is a side elevational view thereof, as seen in the direction of the arrow 2—2 of FIG. 1.

Using the stretch of "one size fits all" and also the ambidextrous nature of glove 10 to their combined fullest advantage, the surfaces of the glove 10, namely as designated in the side elevational view of FIG. 2 as opposite external surfaces 18 and internal surfaces 20, are provided by dying or other well-known techniques with different, contrasting appearances. This is best understood from FIG. 3, to which reference should now be made in which four pairs of the glove 10 are shown in a palm's up orientation, it being understood that the covering of the glove over the back of the hand is a mirror image.

In the pair in the upper left-hand location of the gloves 10, the exterior surfaces 18 will be understood to be a selected solid color, such as pink, light blue, or the like (not color coded). Proceeding to the pair in the upper right-hand location, it will be understood that the gloves 10 have been turned inside-out and now display what was the interior surfaces 20 in an exterior location, and the appearance is of a contrasting nature to the solid color and, more particularly, consists of the color purple in band 22P, color red in band 22R and color green in band 22G, each band being color coded in the drawing to depict the color noted.

In the remaining pairs in the lower left and right-hand locations, the appearance of the glove 10 on one hand is of a solid color and on the other hand of the three-band appearance, and are reversed in the two locations. Thus, in the lower left-hand location, glove 10 to the right is a solid color and glove 10 to the left is of the three-band 22P, 22R, 22G variety, and in the lower right-hand location, after the gloves are turned inside-out, glove 10 to the right is of the three band 22P, 22R, 22G variety and in the lower left-hand location glove 10 is in a solid color.

Figure 3:
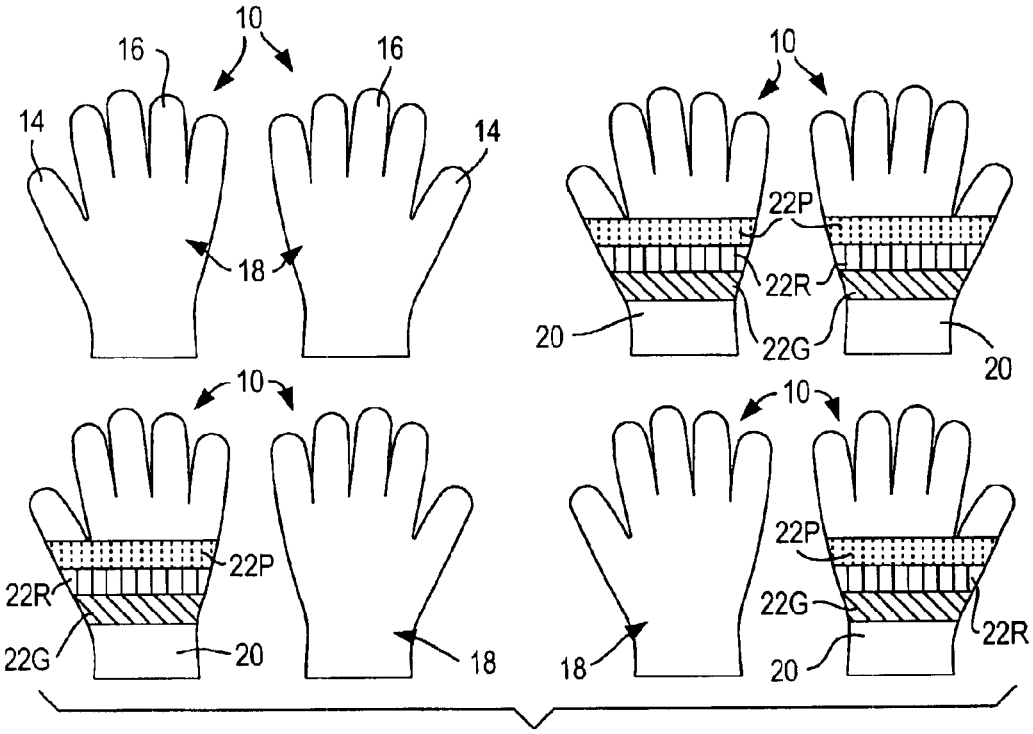
FIG. 3 is a front elevational view, on a reduced scale, of four pairs of the glove demonstrating its display value.

It will thus be understood that glove 10 used in pairs has enhanced display value as demonstrated in FIG. 3.

While the reversible interchangeable stretch fashion glove herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A pair of gloves, each glove of which comprises, in combination, a selected construction material for fit, and said selected construction material for fit having selected opposite first and second surfaces for display, A. said selected construction material for each glove for fit being elastomeric effective to provide operative wearing conditions thereof and a thumb stall and finger stalls in extending relation from a palm, said thumb stall and finger stalls being in a plane of said palm so as to be worn interchangeably on a right hand and on a left hand of a user, and B. said selected opposite first and second display surfaces for said elastomeric construction material for each glove being a first appearance of said first surface and a second differing appearance of said second surface, C. and plural operative wearing conditions of said pair of gloves characterized by a first condition in which both said first surfaces are on a palm of said gloves worn on a user's left and right hands, a second condition in which said first surface is on a palm of said glove on a left hand and said second surface is on a palm of a glove turned inside out worn on a right hand, and a third condition in which said first surface is on a palm of said glove worn on a right hand and said second surface is on a palm of a glove turned inside out worn on a left hand, whereby said gloves have enhanced display value and interchangeable fitting utility.

* * * * *